US010648780B2

(12) United States Patent
Fornusek et al.

(10) Patent No.: US 10,648,780 B2
(45) Date of Patent: May 12, 2020

(54) BALLISTIC PANEL AND BALLISTIC SYSTEM

(71) Applicant: MOB-BARS S.R.O., Prague-Prosek (CZ)

(72) Inventors: Jindrich Fornusek, Prague (CZ); Vladimir Jelinek, Jirkov (CZ); Michal Mara, Ceske Budejovice (CZ); Radoslav Sovjak, Ceske Budejovice (CZ); Jan Zatloukal, Rychnov nad Kneznou (CZ)

(73) Assignee: MOB-Bars s.r.o., Prosek (CZ)

( * ) Notice: Subject to any disclaimer, the term of this patent is extended or adjusted under 35 U.S.C. 154(b) by 0 days.

(21) Appl. No.: 16/073,780

(22) PCT Filed: Feb. 1, 2017

(86) PCT No.: PCT/IB2017/050524
§ 371 (c)(1),
(2) Date: Jul. 28, 2018

(87) PCT Pub. No.: WO2017/134563
PCT Pub. Date: Aug. 10, 2017

(65) Prior Publication Data

US 2019/0033041 A1 Jan. 31, 2019

(30) Foreign Application Priority Data

Feb. 1, 2016 (CZ) ..... 2016-51

(51) Int. Cl.
*F41H 5/24* (2006.01)
*E04C 2/06* (2006.01)
(Continued)

(52) U.S. Cl.
CPC ..... *F41H 5/24* (2013.01); *E01F 13/04* (2013.01); *E01F 15/14* (2013.01); *E04C 2/06* (2013.01);
(Continued)

(58) Field of Classification Search
CPC .. F41H 5/24; E01F 13/04; E01F 15/14; E04C 2/06; E04H 9/10; E04H 17/165; E04H 17/18
(Continued)

(56) References Cited

U.S. PATENT DOCUMENTS 2,688,244 A * 9/1954 Stavrou ..... E04B 2/28 52/566
2,930,222 A * 3/1960 Bender ..... E04H 7/28 52/286
(Continued)

FOREIGN PATENT DOCUMENTS

EP 0269715 B1 6/1988
GB 537134 A * 6/1941 ..... E04H 9/10
(Continued)

OTHER PUBLICATIONS

International Search Report (dated May 26, 2017) for corresponding International App. PCT/IB2017/050524.

*Primary Examiner* — John Cooper
(74) *Attorney, Agent, or Firm* — WRB-IP LLP

(57) ABSTRACT

A ballistic panel for special checkpoints, special fortified stands, mobile city barriers and any other similar structures especially is made by use of fibre reinforced or rebar reinforced cementitious composite for its production.

5 Claims, 6 Drawing Sheets

(51) Int. Cl.

| | |
|---|---|
| ***E04H 9/10*** | (2006.01) |
| ***E04H 17/18*** | (2006.01) |
| ***E01F 13/04*** | (2006.01) |
| ***E01F 15/14*** | (2006.01) |
| ***E04H 17/16*** | (2006.01) |

(52) U.S. Cl.
CPC ..... *E04H 9/10* (2013.01); *E04H 17/165* (2013.01); *E04H 17/18* (2013.01)

(58) Field of Classification Search
USPC ..... 89/36.01, 36.02, 36.04; 52/286
See application file for complete search history.

(56) References Cited

U.S. PATENT DOCUMENTS 4,111,401 A * 9/1978 Pickett ..... E01F 8/0017 256/13.1
4,833,855 A * 5/1989 Winter, IV ..... E04C 2/288 52/591.4
5,123,773 A * 6/1992 Yodock ..... E01F 15/088 256/13.1
5,381,638 A * 1/1995 Andersson ..... E04B 2/08 52/592.1
5,685,665 A * 11/1997 Lembo ..... E01F 15/025 256/13.1
6,460,309 B1 * 10/2002 Schneider ..... E04B 1/0046 52/837
9,404,234 B2 * 8/2016 Jain ..... E02D 27/32
2005/0066587 A1 * 3/2005 Brisson ..... E04B 1/12 52/79.1
2009/0320403 A1 * 12/2009 Love ..... F24B 1/18 52/592.6
2012/0207541 A1 * 8/2012 Maus ..... E01F 15/143 404/6
2013/0072086 A1 * 3/2013 Saneshige ..... A63H 33/008 446/478
2014/0308072 A1 * 10/2014 Sagy ..... E01F 15/025 404/6
2015/0337508 A1 * 11/2015 Torres, Jr. ..... B29C 70/58 404/6
2016/0076238 A1 * 3/2016 Elliott ..... A63H 33/008 52/742.13

FOREIGN PATENT DOCUMENTS

GB 537134 A 6/1941
WO 2009111302 A2 9/2009

* cited by examiner

[Fig. 1]
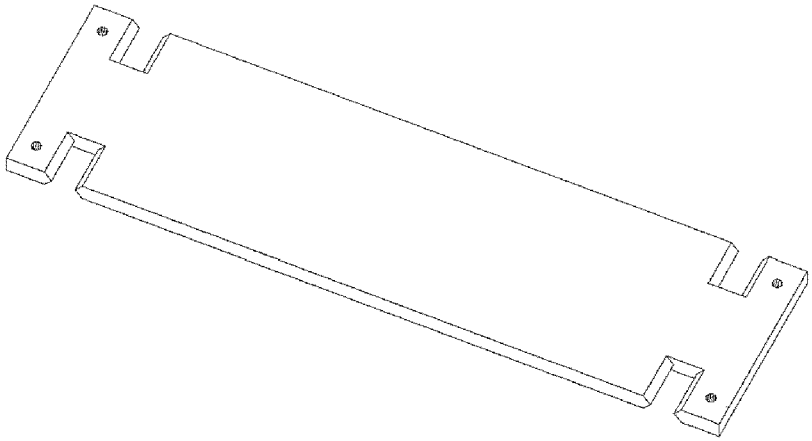
[Fig. 2]
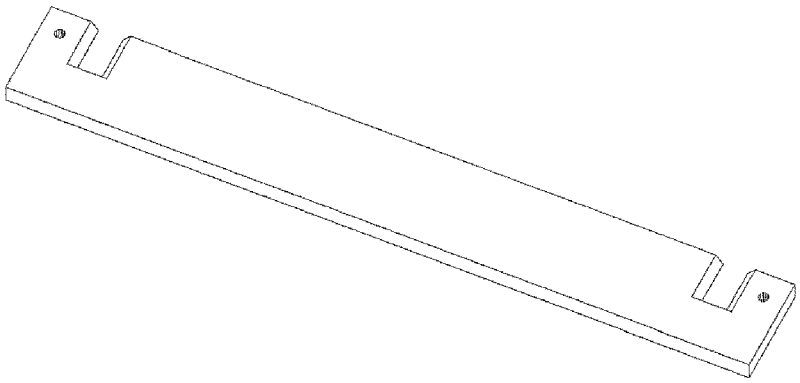
[Fig. 3]
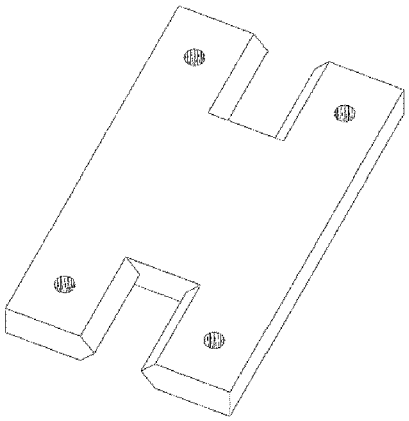
[Fig. 4]
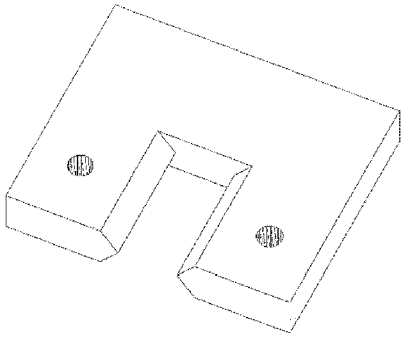

[Fig. 5]
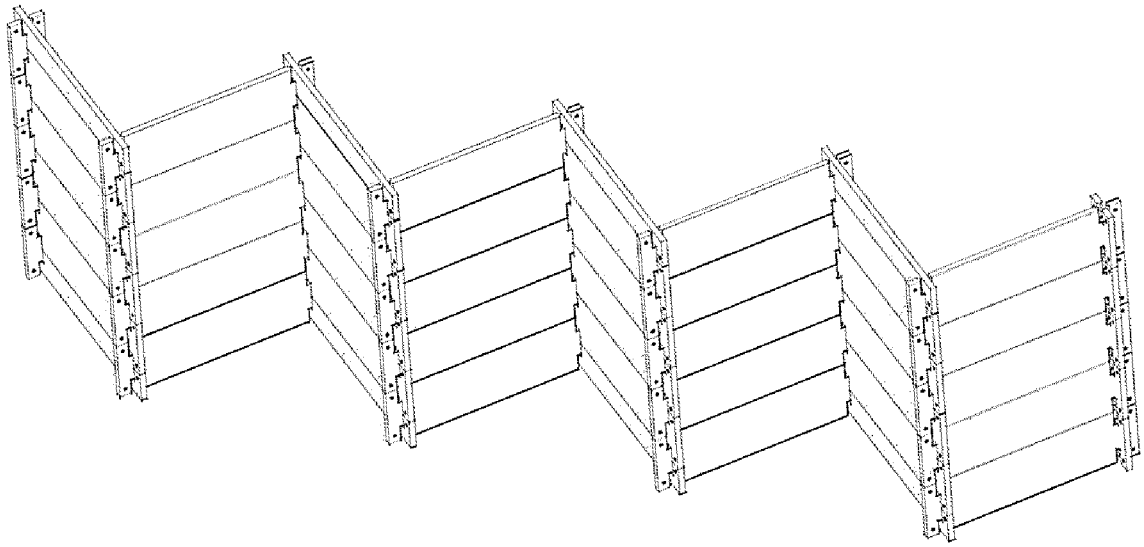
[Fig. 6]
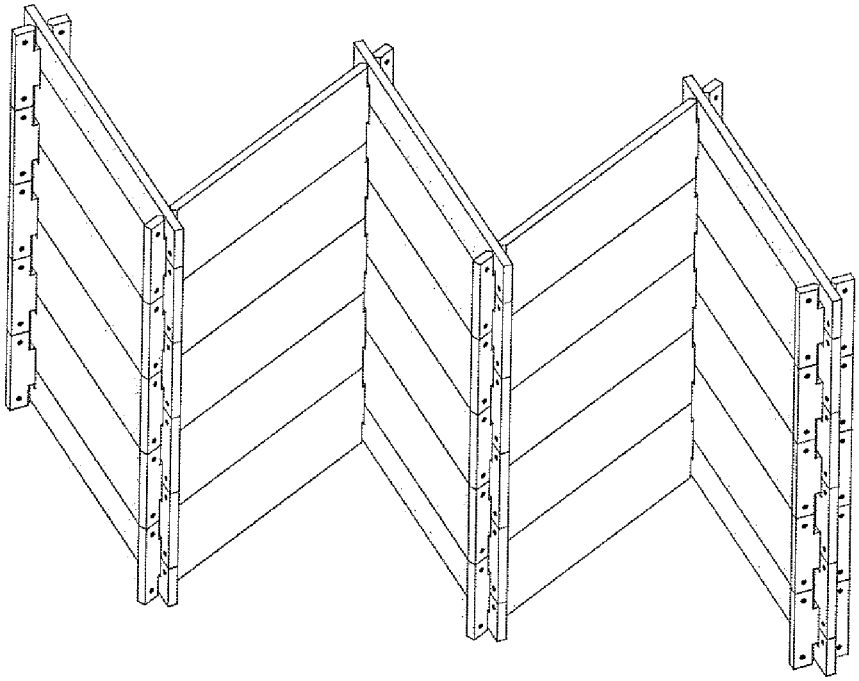

[Fig. 7]
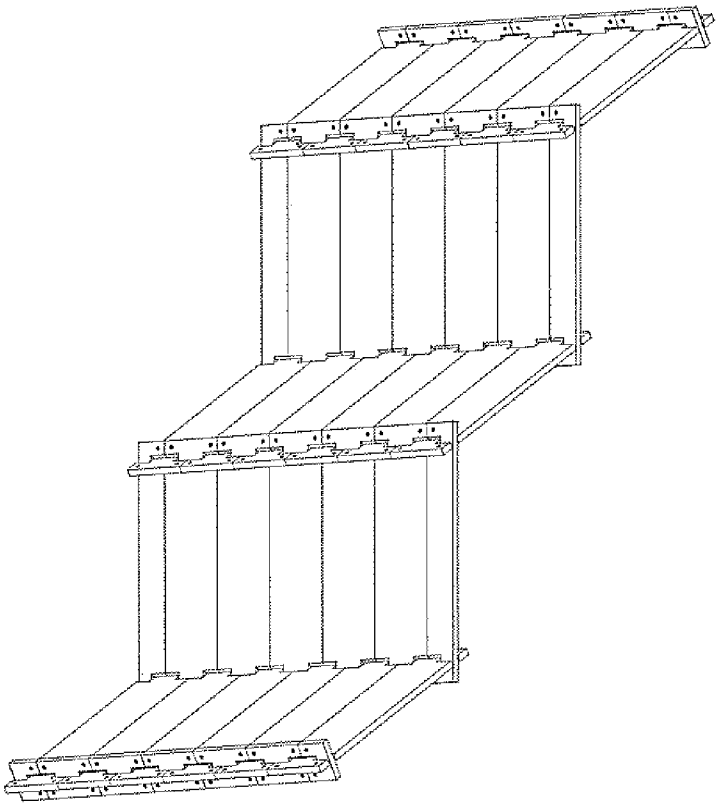

[Fig. 8]
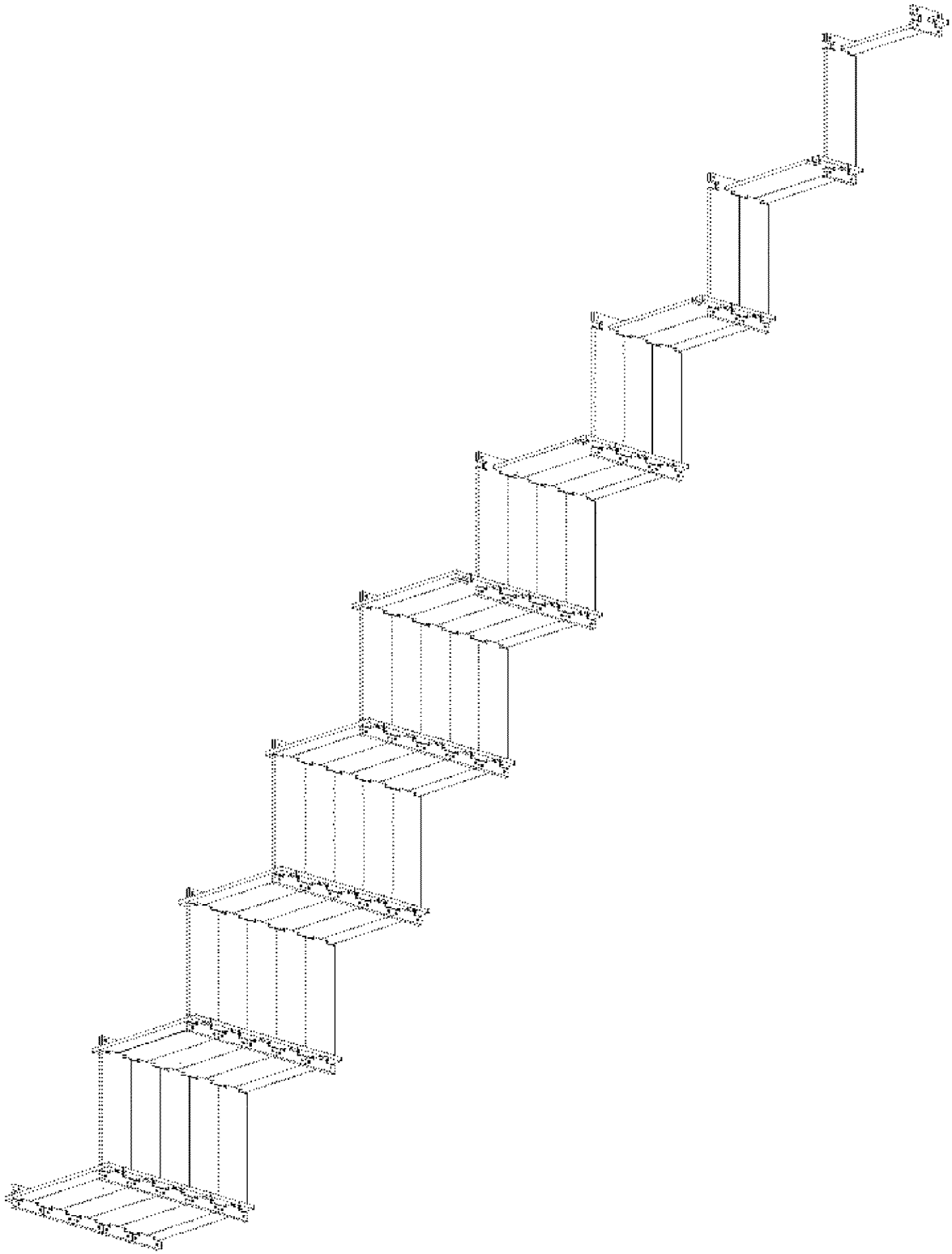

[Fig. 9]
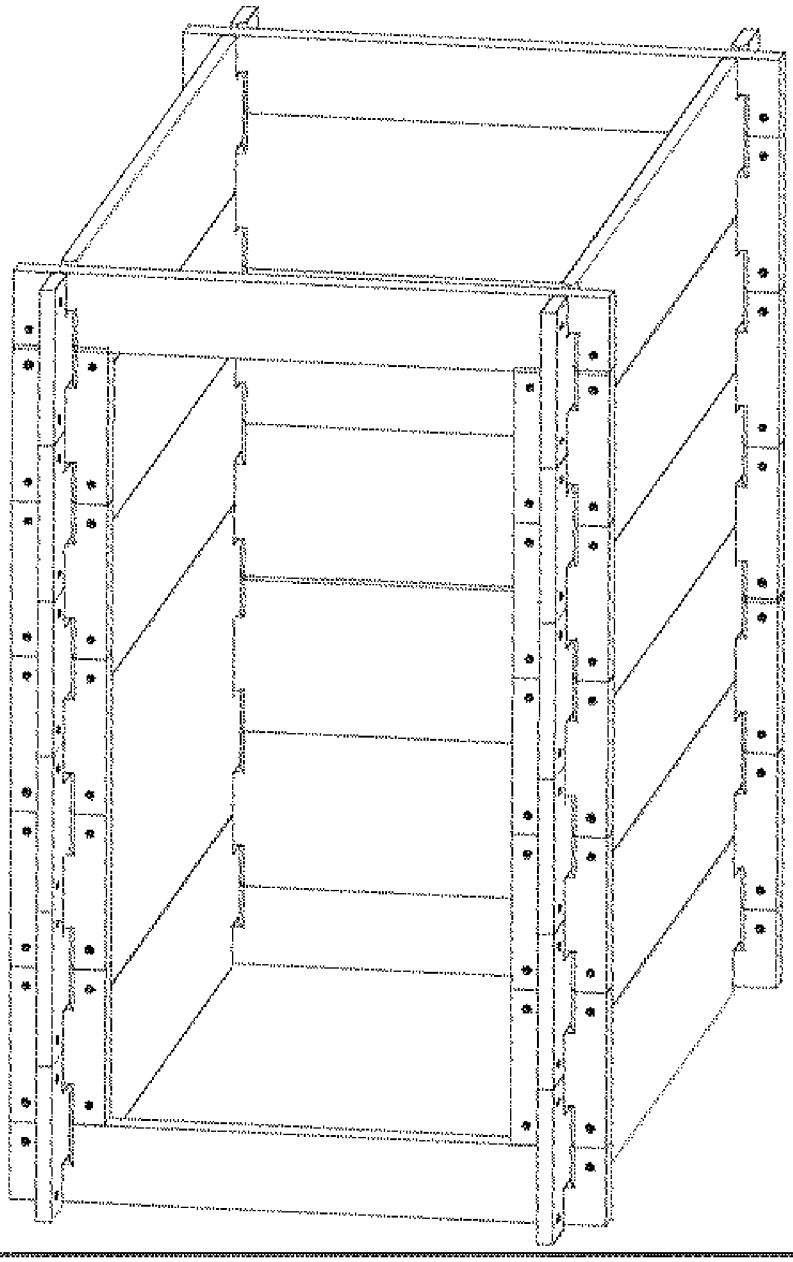

[Fig. 10]
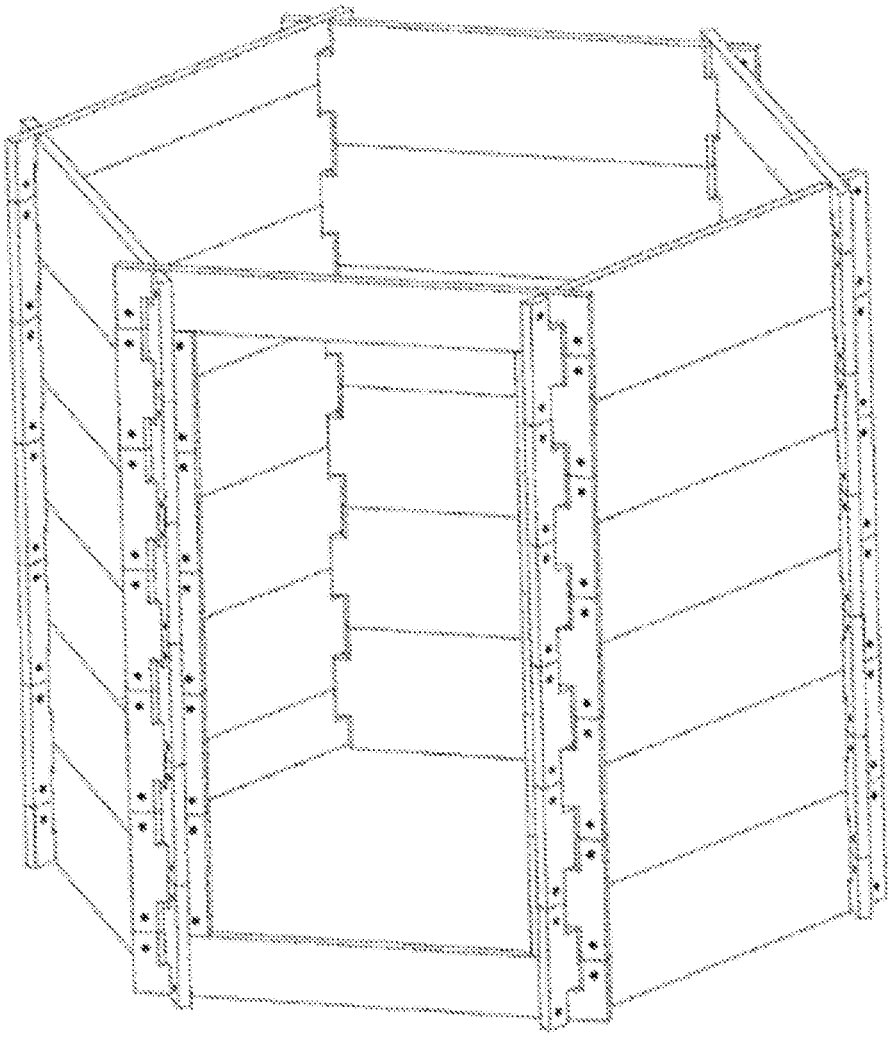
Fig. 11
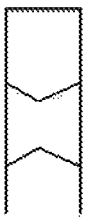
Fig. 12
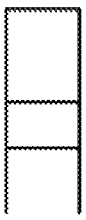
Fig. 13
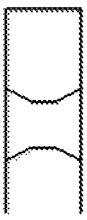
Fig. 14
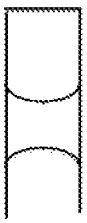
Fig. 15
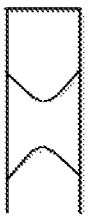

BALLISTIC PANEL AND BALLISTIC SYSTEM

BACKGROUND AND SUMMARY

Technical solution is concerned to the ballistic panel for special check points, special fortified post, mobile city barriers, diplomatic buildings, buildings of strategic infrastructure, barriers for blast absorption in technological structures and absorption of blast generated fragments, especially. Technical solution is also concerned to ballistic system for special check points, special fortified post, mobile city barriers, diplomatic buildings, buildings of strategic infrastructure, barriers for blast absorption in technological structures and absorption of blast generated fragments, especially. The ballistic system is consisted of or comprises ballistic panels.

Ballistic panels are designed as heavy structures with focus on large weight nowadays. Ballistic systems are usually made of two steel corrugated sheets and ballistic fabric which is placed between the sheets. Bullet proof fabric can be also stuck to one of the sheets. Corrugated sheets are necessary to be connected together. System where ballistic panels are set into heavy foundation is another type of ballistic system. This foundation can be moved by heavy machinery only. The system where the ballistic panels axe connected together by steel products is also another type of ballistic system. These types of structures are characterized by long time of construction or by heavy machinery necessity. Another composition of ballistic panels is made of aluminium layer (one or both sides) and inner part. Inner part is supposed to be made of ballistic, glass or steel, kevlar, nylon or ceramics inserts. These materials are very resistant but those price is very high which can disadvantage these material amongst the others. It is also necessary to make large scale repair when these panels are broken.

Previously stated disadvantages are significantly reduced by ballistic panel. Ballistic panel is basic building block for special check points, fortified outposts, mobile barrier for cities and other similar structures. The basis of the ballistic panel is composed of light, easily manipulating blocks. These blocks are equipped by so called locks. These locks allow to connect the blocks together which create the ballistic structure.

The invention is illustrated using the attached drawing, wherein FIG. 1 is a block diagram of an exemplary apparatus according to the invention.

It is advantageous that the ballistic panel is made of fibre reinforced or rebar reinforced cemenitious composite. It is also advantageous that locks in ballistic panel allow rotating the mutual neighbouring ballistic panels within the defined angle. Locks are flat, pointed, dull, hemispherical, ogive, convex or concave in the cross section.

Locks in ballistic panel are created by skipping of material on the top or bottom surface of ballistic panel and lock pervade through the whole thickness of the ballistic panel. Surface of the lock is made of material of ballistic panel. Surface of the lock can be provided by metallic or by other different resistant material for abrasion resistance increase.

Ballistic panel can be provided with one or more hole. These holes can be used for connecting or anchoring of the ballistic panels together by connecting parts. This kind of construction is very fast and time efficient, it also needs no technological breaks. The construction s carried without wet process. Only connections of mechanical parts are used for the construction.

Ballistic system which is consisted of or comprises ballistic panels can be shaped and sized arbitrarily. Ballistic system can be also built as open or closed ground plan system. This system is self standing, it does not need any kind of specialized ground anchoring, any kind of supports. It also provides adequate safety against overturn at the same time. This overturn safety is guaranteed by weight and geometry of the system. Width of system foundations can be changed by change of angle of connection of neighbouring wall.

BRIEF DESCRIPTION OF THE DRAWINGS

Ballistic system consisted of or comprises easily manipulating parts allows easy and fast replacement of broken part without heavy machinery deployment.

Technical solution is closely explained via drawings where

FIG. 1 shows full size of single panel which is block shaped with skipped parts in the shape of the so called locks and holes for connecting and anchoring parts;

FIG. 2 shows half panel which size corresponds to the shorter panel of the full size panel that was cut in the axis parallel to the longest dimension of the panel;

FIG. 3 shows short panel which is the same characteristics like the full size panel, but its length (the length is defined as the longest dimension of the full size panel) is smaller and its predominant dimension can be height;

FIG. 4 shows panel of half size of panel depicted on FIG. 3;

FIG. 5 shows ballistic system which consists of or comprises two ballistic panels at least that are connected together by locks, connection is created by inserting of the locks together so the ballistic panels defined by their outer dimensions intersects each other, ballistic system can be consisted of or comprise different numbers of ballistic panels that can be different shapes and dimensions;

FIG. 6 shows ballistic system where neighbouring walls holds acute angle;

FIG. 7 shows ballistic system where neighbouring walls holds obtuse angle, ballistic system can be consisted of or comprise any number of neighbouring walls holding different angles;

FIG. 8 shows the meaning of ballistic panels connecting together into the walls and ballistic system;

FIG. 9 shows one of possible realization of check point or fortified stand with squared base;

FIG. 10 shows one of the possible realization of check point or fortified stand with hexagonal base;

FIG. 11-15 shows cross sections of possible shapes of locks which are created by skipping of material on the top or/and bottom surface of ballistic panel and lock pervade through the whole thickness of the ballistic panel;

FIG. 11 shows pointed lock;

FIG. 12 shows flat lock;

FIG. 13 shows obtuse lock;

FIG. 14 shows hemispherical lock;

FIG. 15 shows ogive lock.

DETAILED DESCRIPTION

Technical solution is concerned to the ballistic panel for special check points special fortified post, mobile city barriers, diplomatic buildings, buildings of strategic infrastructure, barriers for blast absorption in technological structures and absorption of blast generated fragments, especially. Technical solution is also concerned to ballistic system for special check points, special fortified post, mobile city barriers, diplomatic buildings, buildings of strategic infrastructure, barriers for blast absorption in technological structures and absorption of blast generated fragments, especially. The ballistic system is consisted of or comprises ballistic panels. Panel's dimensions are typically 1 to 2 meters length 0.3 to 1 meter width and 20 to 100 mm thick.

It is advantageous that the ballistic panel is made of fibre reinforced or rebar reinforced cementitious composite e.g. composite like FRC, HPFRC or UHPFRC with fractural energy 1000 J/m2 at least and minimal ballistic class 2 due to EN 1522/1523 when thickness is 40 mm.

Ballistic panel is provided by locks that are flat, pointed, dull, hemispherical, ogive, convex or concave. Ballistic panel can be straight, spherical, parabolic or generally curved. FIGS. 11-15 shows cross sections of possible shapes of locks of the ballistic panel and lock and which extend through the whole thickness of the ballistic panel, where FIG. 11 shows a pointed lock, FIG. 12 shows a flt lock, FIG. 13 shows a obtuse lock, FIG. 14 shows a hemispherical lock, and FIG. 15 shows an ogive lock.

Ballistic system consists of or comprises two ballistic panels at least that are connected together by locks. Connection is created by inserting of the locks together so the ballistic panels defined by their outer dimensions intersects each other. Ballistic system can be consisted of or comprise different numbers of ballistic panels that can be different shapes and dimensions.

Fibre reinforced or rebar reinforced cementitious composite is material used for the ballistic panels. This material guarantees sufficient resistance against freezing and defrosting cycles and also against the chemical defrosting solutions. This ability ensures high life expectancy and permanent qualities during the time.

Ballistic system which is consisted of or comprises ballistic panels can be shaped and sized arbitrarily. Ballistic system can be also built as open or closed ground plan system.

INDUSTRIAL APPLICABILITY

Ballistic panel and ballistic system according to this technical solution is applicable within many branches of civil and military sector as special checkpoints, special fortified stands, mobile city barriers and any other similar structures. Ballistic panels and ballistic system according to this technical solution is applicable for technological industry for blast and blast generated fragments absorption.

The invention claimed is:

1. A protective ballistic panel comprising fiber reinforced or rebar reinforced cementitious composite and locking recesses in edges of the ballistic panel that are configured to interengage with locking recesses in edges of other protective ballistic panels and to be rotated relative to the other protective ballistic panels through a range of angles from an acute angle to an obtuse angle while interengaged.

2. The protective ballistic panel according to claim 1, wherein the locking recesses comprise flat, pointed, dull, hemispherical, ogive, convex or concave walls.

3. The protective ballistic panel according to claim 1, wherein the ballistic panel comprises top and bottom edges and locking recesses disposed in at least one of the top and bottom edges through an entire thickness of the ballistic panel.

4. A protective ballistic panel system comprising at least two ballistic panels according to claim 1, the two ballistic panels being connected together by interengaging locking recesses in edges of the ballistic panels so that outer portions of the edges of each of the two ballistic panels extend through recesses of the other one of the two ballistic panels.

5. The protective ballistic panel system according to claim 4, wherein the two ballistic panels have different shapes and dimensions.

* * * * *